US007731096B2

(12) United States Patent
Lorenz et al.

(10) Patent No.: US 7,731,096 B2
(45) Date of Patent: Jun. 8, 2010

(54) CONTROLLER FOR TWO-STAGE HEAT SOURCE USABLE WITH SINGLE AND TWO STAGE THERMOSTATS

(75) Inventors: Thomas B. Lorenz, St. Louis, MO (US); David L. Perry, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 1253 days.

(21) Appl. No.: 11/265,695

(22) Filed: Nov. 2, 2005

(65) Prior Publication Data

US 2007/0095520 A1 May 3, 2007

(51) Int. Cl.

| | |
|---|---|
| ***F24F 11/053*** | (2006.01) |
| ***F24H 9/20*** | (2006.01) |
| ***G05D 23/19*** | (2006.01) |
| ***F25D 23/12*** | (2006.01) |

(52) U.S. Cl. ..... 236/1 C; 236/1 E; 236/11; 236/46 C; 165/267

(58) Field of Classification Search ..... 236/1 C, 236/46 C; 165/267

See application file for complete search history.

(56) References Cited

U.S. PATENT DOCUMENTS

| | | | | |
|---|---|---|---|---|
| 3,785,432 | A * | 1/1974 | Kabat et al. | 165/216 |
| 4,425,930 | A * | 1/1984 | Kruto | 137/1 |
| 5,022,460 | A * | 6/1991 | Brown | 165/262 |
| 5,115,968 | A * | 5/1992 | Grald | 236/78 D |
| 5,410,230 | A * | 4/1995 | Bessler et al. | 318/471 |
| 5,806,760 | A | 9/1998 | Maiello | |
| 6,230,979 | B1 | 5/2001 | Vendt et al. | |
| 6,244,515 | B1 * | 6/2001 | Rowlette et al. | 236/1 E |
| 6,370,894 | B1 | 4/2002 | Thompson et al. | |
| 6,450,409 | B1 * | 9/2002 | Rowlette et al. | 236/1 E |
| 6,826,917 | B1 * | 12/2004 | Bodell et al. | 62/115 |
| 6,925,999 | B2 | 8/2005 | Hugghins et al. | |
| 2004/0075660 | A1 * | 4/2004 | Liao et al. | 345/441 |

* cited by examiner

*Primary Examiner*—Frantz F. Jules
*Assistant Examiner*—Travis Ruby
(74) *Attorney, Agent, or Firm*—Harness, Dickey & Pierce, P.L.C.

(57) ABSTRACT

A controller for a two-stage heat source is provide, which may be connected to either a single stage or a two-stage thermostat to provide low stage heating for a variable time period before switching to high stage heating. The controller includes at least a first terminal for receiving a signal requesting heating from a single-stage thermostat or a two-stage thermostat connected to the first terminal. A microcontroller in communication with the first terminal determines a duty cycle value for a heating cycle based on the duration in which a signal at the first terminal is present relative to the duration of the heating cycle. The microcontroller determines a low stage time limit from the duty cycle, and provides low stage heating when a signal is present at the first terminal for a time period not more than the time limit, and switches to high stage heating after the time limit.

20 Claims, 3 Drawing Sheets

CONTROLLER FOR TWO-STAGE HEAT SOURCE USABLE WITH SINGLE AND TWO STAGE THERMOSTATS

FIELD OF THE INVENTION

The present invention relates to a controller for a two-stage heat source that can be used with either a single or a two-stage thermostat.

BACKGROUND OF THE INVENTION

There are two types of commonly available, gas-fired, warm air furnaces in the marketplace: those with a single gas flow rate, and those with two or more gas flow rates. These are referred to as single and multistage furnaces, respectively. Multistage furnaces are frequently selected by homeowners for replacement furnaces because they offer increased performance and comfort. In retrofit applications there is typically an existing single stage thermostat and wiring in place. It can be troublesome to install a multistage thermostat in a retrofit application when a single stage thermostat is already in place because of the need to route additional wiring through walls for the additional stages. For simple and economical installation, it is desirable to be able to continue to use a single stage thermostat and thermostat wiring when replacing a single stage furnace with a multistage furnace.

Several attempts have been made to allow a single stage thermostat with two-stage furnaces. In some two-stage furnace controls, the controller switches to second stage heating if the demand for heat is not satisfied within a set predetermined time, such as ten minutes. Such furnace controls operate the second stage of heating after some pre-set time has expired, independent of the level of heating actually required at the time.

SUMMARY OF THE INVENTION

Various embodiments of a controller for a two-stage heat source are provided, which may be connected to either a single stage or a two-stage thermostat and control the two-stage heat source to provide low stage heating operation for a demand-based variable time period before switching to high stage heat operation. One embodiment of a controller comprises at least a first terminal for receiving a signal requesting heating from a single-stage thermostat connected to the first terminal, or for receiving a signal requesting low-stage heating from a two-stage thermostat connected to the first terminal. The controller includes a microcontroller in communication with the first terminal, and is configured to determine a duty cycle value for one or more heating cycles based on the duration of time in which a signal at the first terminal is present relative to the duration of the heating cycle. The microcontroller determines a low stage time limit that corresponds to the calculated duty cycle value. The microcontroller controls the two-stage heat source to provide low stage heating operation when a signal is present at the first terminal for a time period not more than the low stage time limit, and high stage heating operation when a first stage signal is present beyond the low stage time limit. The low stage time limit value diminishes as the duty cycle value indicative of the heating load demand increases, such that low stage heat operates for a minimum low stage time limit period prior to activation of high stage heat operation when heating demand is high, and low stage heat operates for a maximum low stage time limit period prior to activation of high stage heat operation when heating demand is low.

Some embodiments of a controller further comprise a second terminal for receiving a signal requesting high-stage heat operation from a two-stage thermostat, wherein the microcontroller is in communication with the second terminal and initiates second stage heating upon receiving a signal requesting second stage heat from a two-stage thermostat.

Various embodiments of a method are also provided for controlling the operation of a two stage furnace. In one embodiment, the method comprises determining whether a request signal for heat operation is present at a first terminal, and if so, initiating low stage heat operation. The method calls for calculating at least one duty cycle value based on the duration of time in which a request signal was present at the first terminal in a previous heating cycle relative to the total duration of the previous heating cycle, which duty cycle value is used to determine a low stage time limit value. The method for controlling the two-stage heat source provides for low stage heating operation as long as a signal is present at the first terminal until either a low stage time limit or a default time limit is reached, and then provides for high stage heating operation after the low stage time limit or default time limit has been reached. The method discontinues all heating operation when the signal at the first terminal is no longer present.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EMBODIMENTS

The following description of the various embodiments is merely exemplary in nature and is in no way intended to limit the invention, its application, or uses.

Figure 1:
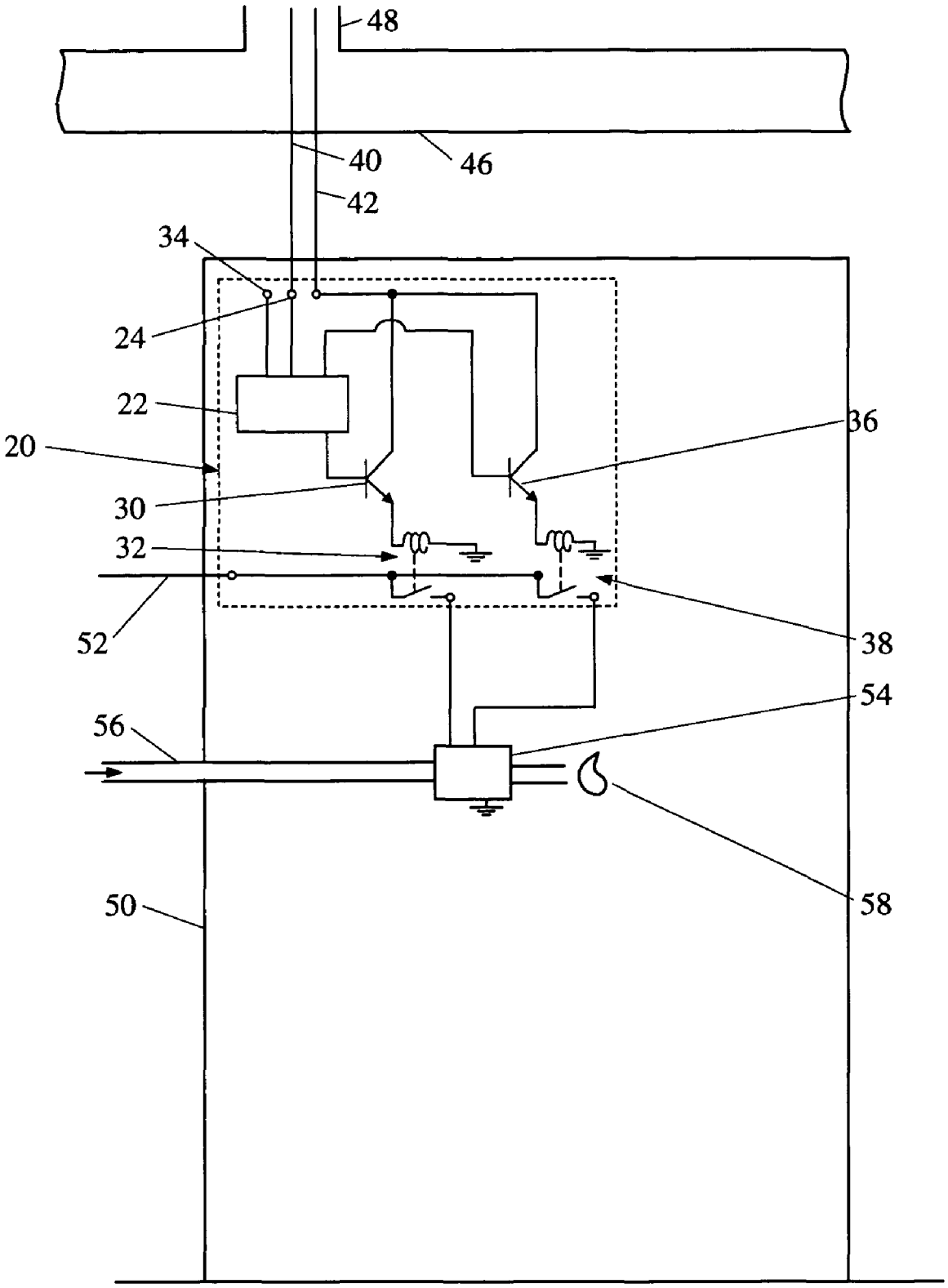
FIG. 1 is a schematic diagram showing one embodiment of a controller for a two-stage heat source according to the principles of the present invention.
Figure 2:
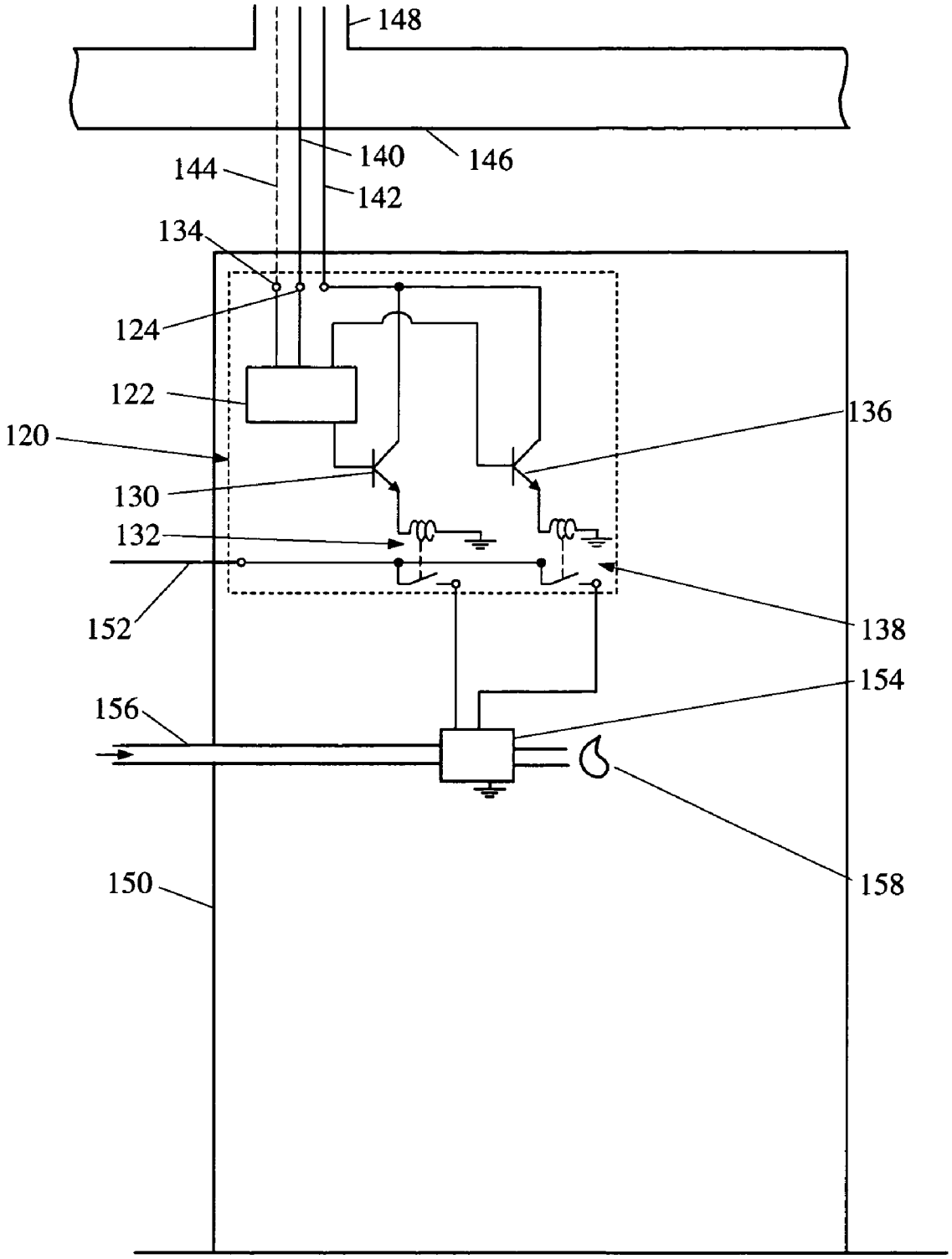
FIG. 2 is a schematic diagram showing a second embodiment of a controller for a two-stage heat source.

In the various embodiments of the present invention, a controller for a two-stage heat source is provided that is adapted to be connected to either a single stage or a two-stage thermostat. In one embodiment shown generally as 20 in FIG. 1, a controller 20 is provided that comprises a microcontroller 22 and a first terminal 24 for receiving a signal requesting heating from a single-stage thermostat (not shown) connected to the first terminal 24 via wire 40. It is desirable to be able to use the previously installed single stage thermostat and thermostat wiring when replacing a single stage furnace with a multistage furnace 50, because of the need to route additional wiring through flooring 46 and walls 48 for the additional stages. The control 20 is configured to receive a single signal requesting heating operation, and to responsively establish operation of first stage heating followed by second stage heating depending on the heating demand. Specifically, the control 20 comprises a first switching means 30 for switching a 24 volt power source connected to the control 20 at 42 to a relay device 32, which switches power at 52 to a gas valve 54 to establish low stage heating operation at a burner 58. The control 20 further comprises a second switching means 36 for switching the 24 volt power source connected to the control 20 at 42 to a relay device 38, which switches power at 52 to a second connection on the gas valve 54 to establish high stage heating operation at a burner 58. The control 20 is capable of receiving a request for heat signal at a first terminal 24, and responsively switching a first and second switch means 30 and 36 to operate a two stage heat source in either first stage heat or second stage heat mode depending on the heating demand as explained below.

The microcontroller 22 is configured to control the operation of a two stage heat source to provide first or low stage heating operation for a demand-based variable time period before switching the heat source to high stage heat operation. The time in which the first stage heat operates is varied by means of a duty cycle value that is indicative of the heating load demand. The control 20 includes a microcontroller 22 in communication with the first terminal 24, which is configured to calculate a duty cycle value based on the ratio of the duration of time in which a signal requesting or calling for heat is present at the first terminal 24 versus the on and off time of a heating cycle. For example, a duty cycle value of 80 percent is calculated where a 20 minute duration of heating operation was followed by a 5 minute off period before the start of the next heating cycle, to yield 20 minutes on during a 25 minute on and off heat cycle. The microcontroller 22 further determines a first stage time limit value 28 from the calculated duty cycle value, wherein the first stage time limit value may be one of a plurality of time limit values in a look-up table that each correspond to a plurality of duty cycle value ranges (see Table 1). Initially, in the absence of a calculated duty cycle value, or a first stage time limit value 28 based on a duty cycle, a default time limit value, such as 15 minutes for example, may be used.

In the various embodiments, the first stage of heating operation provides a lower level of heating operation than the second stage of heating operation. While a request for heat signal is present at the first terminal 24, the microcontroller 22 controls the operation of a two stage heat source to provide first or low stage heating operation for a time period not more than the low stage time limit (ie.—the default value or the time limit value determined from the duty cycle). The microcontroller 22 then provides second high stage heating when a request for heat signal has been present at the first terminal 24 beyond the low stage time limit period. Unlike controllers that switch to high stage heating after a fixed time delay no matter what level of heating is actually required, the present control enables the extent to which low stage heat is operated before switching to high stage heat to be varied to fit the duty cycle value or heating load demand for the two-stage heating source.

In some embodiments of a two-stage heat source controller, the microcontroller 22 selects one of a plurality of time delay values from a look-up table in a memory of the microcontroller 22, where the plurality of low stage time delay values 28 correspond to a plurality of duty cycle value ranges. The duty cycle value range is generally proportional to the heating load demand of the two stage heating system, and is generally inversely proportional to the corresponding low stage time limit value, as shown in the Table below. Referring to Table 1, the low stage time limit value diminishes as the duty cycle value indicative of the heating load demand increases, such that low stage heat operates for a minimum low stage time limit period prior to activation of high stage heat operation when heating demand is high, and low stage heat operates for a maximum low stage time limit period prior to activation of high stage heat operation when heating demand is low.

TABLE 1

Duty Cycle and Low Stage Time Limit Values

| Duty Cycle Range (%) | Low Stage Time Limit | Heating Load Demand |
|---|---|---|
| 0 to 38 | 12 minute low stage | Light |
| 38 to 50 | 10 minutes low stage | Light to Average |
| 50 to 62 | 7 minutes low state | Average |
| 62 to 75 | 5 minutes low stage | Average to Heavy |
| 75 to 88 | 3 minutes low stage | Heavy |
| 88 to 100 | 1 minute low stage | Heavy |

Some embodiments of a controller 20 may further comprise a second terminal 34 for receiving a signal requesting second stage heat from a two-stage thermostat (not shown) that is connected to the second terminal 34. The microcontroller 22 is in communication with the second terminal 34, and initiates second stage heating upon receiving a signal for second stage heat from a two-stage thermostat regardless of the low stage time limit determined by the calculated duty cycle. In some embodiments, the microcontroller 22 calculates one or more duty cycle values during one or more heating cycles. The microcontroller 22 is also configured to store at least one calculated duty cycle value in a memory. In one embodiment of a controller, the microcontroller 22 stores the calculated duty cycle in a memory and averages a subsequently calculated duty cycle value with at least one previously stored duty cycle value, for determining a low stage time limit period based on the averaged duty cycle value. The controller may for example, average 3 previous duty cycle values to determine a current duty cycle value.

In a second embodiment, a two-stage heat source controller 120 adapted to be used with a single stage or two stage thermostat. The control 120 comprises a first terminal 124 for receiving a signal requesting heating from a single-stage thermostat connected to the first terminal 124. While it is desirable to be able to use the previously installed single stage thermostat and thermostat wiring when replacing a single stage furnace with a multistage furnace 150, the terminal 124 may alternatively receive a signal requesting first-stage heat from a two-stage thermostat that is connected to the first terminal 124 via wire 140. The control 120 may further include a second terminal 134 for establishing a second stage connection via an additional wire 144 to a two stage thermostat, where the single stage thermostat is to be replaced by a multi-stage thermostat. The control 120 may comprise a first switching means 130 for switching a 24 volt power source connected to the control 120 at 142 to a relay device 132, which switches power at 152 to a gas valve 154 to establish low stage heating operation at a burner 158. The control 120 may further comprise a second switching means 136 for switching the 24 volt power source connected to the control 120 at 142 to a relay device 138, which switches power at 152 to a second connection on the gas valve 154 to establish high stage heating operation at a burner 158. The control 120 is capable of receiving a request for heat signal at a first terminal 124, and a request for second stage heat at a second terminal 134, and responsively switching a first and second switch means 130 and 136 to operate a two stage heat source in either first stage heat or second stage heat mode depending on the level of heating demand.

The controller 120 includes a microcontroller 122 in communication with the first and second terminals 124 and 134. The microcontroller 122 is configured to determine a duty cycle value for one or more heating cycles based on the ratio of the duration of time in which a heat signal is present at the first terminal 124 versus the total on and off time of a heating cycle. The microcontroller 122 capable of selecting one of a number of low stage time limits 128 from a look-up table in a memory of the microcontroller 122, which time limits respectively correspond to a plurality of duty cycle value ranges. The microcontroller 122 accordingly calculates a duty cycle and selects a low stage time limit value 128 corresponding to the range in which the calculated duty cycle falls within. The microcontroller 122 controls the operation of the two stage heat source to provide low stage heating operation when a signal is present at the first terminal 124 for a time period that is less than the low stage time limit 128, and to provide high stage heating operation while a first stage signal is present at the first terminal 124 beyond the low stage time limit 128.

In the second embodiment, the microcontroller 122 controls the operation of the two stage heat source to provide second stage heating whenever a signal requesting second stage heat operation is present at the second terminal 134, regardless of the low stage time limit 128. The second embodiment may further comprise a timer means 136 that is initiated upon activation of low stage heating operation, which timer is appropriately set to the low stage time limit 128. The timer means 136 may be an electrical component physically incorporated into the control, or may be a part of a program subroutine that provides a basic timer function. Upon expiration of the timer 136, the microprocessor 122 provides for high stage heating operation as long as a signal is still present at the first terminal 124. The second embodiment of a controller may also include a look-up table similar to that in Table 1, wherein the low stage time limit value 128 diminishes as the duty cycle ranges indicative of the heating load demand increases. Accordingly, low stage heat may be operated for a minimum low stage time limit 128 period, such as 1 minute for example, prior to activation of high stage heat operation when heating demand is high (duty cycle>88%). Likewise, low stage heat may be operated for a maximum low stage time limit period 128, such as 15 minutes for example, prior to activation of high stage heat operation when heating demand is low (duty cycle<15%).

In the second embodiment, the microcontroller 122 is configured to calculate one or more duty cycle valves during one or more heating cycles. The microcontroller 122 is also configured to store at least one calculated duty cycle value in a memory. In one embodiment of a controller, the microcontroller 122 stores the calculated duty cycle in a memory and averages a subsequently calculated duty cycle value with at least one previously stored duty cycle value, for determining a low stage time limit period based on the averaged duty cycle value.

Various embodiments of a method for controlling the operation of a two stage furnace are also provided. In one embodiment of a method, the method comprises determining whether a request signal for heat operation is present at a first terminal, and if so, providing for low stage heating operation upon detecting a request signal for heat operation at the first terminal. The method includes the step of calculating a duty cycle value based on the ratio of time in which a request signal is present at the first terminal relative to the total on and off time of at least one previous heating cycle. The duty cycle may further comprise the step of averaging the calculated duty cycle from the last heating cycle with at least one stored duty cycle value, to yield an averaged duty cycle value that is used to determine a low stage time limit value. The method determines a low stage time limit value from the calculated duty cycle value or averaged duty cycle value. As long as a signal is present at the first terminal, low stage heating operation is continued for a period of time not more than either a low stage time limit or a default time limit. The method then provides for high stage heating operation after the low stage time limit or default time limit has been reached, as long as the signal at the first terminal remains present. All heating operation is discontinued when the signal at the first terminal is no longer present. The method may further comprise the step of activating high stage heating operation upon detecting a request signal for high stage heating operation at a second terminal, regardless of the duration of low stage heating operation. The method accordingly provides a low stage time limit value that diminishes as the duty cycle value indicative of the heating load demand increases, such that low stage heat may be operated for a minimum low stage time limit period prior to activation of high stage heat operation when heating demand is high, and low stage heat may be operated for a maximum low stage time limit period prior to activation of high stage heat operation when heating demand is low.

Figure 3:
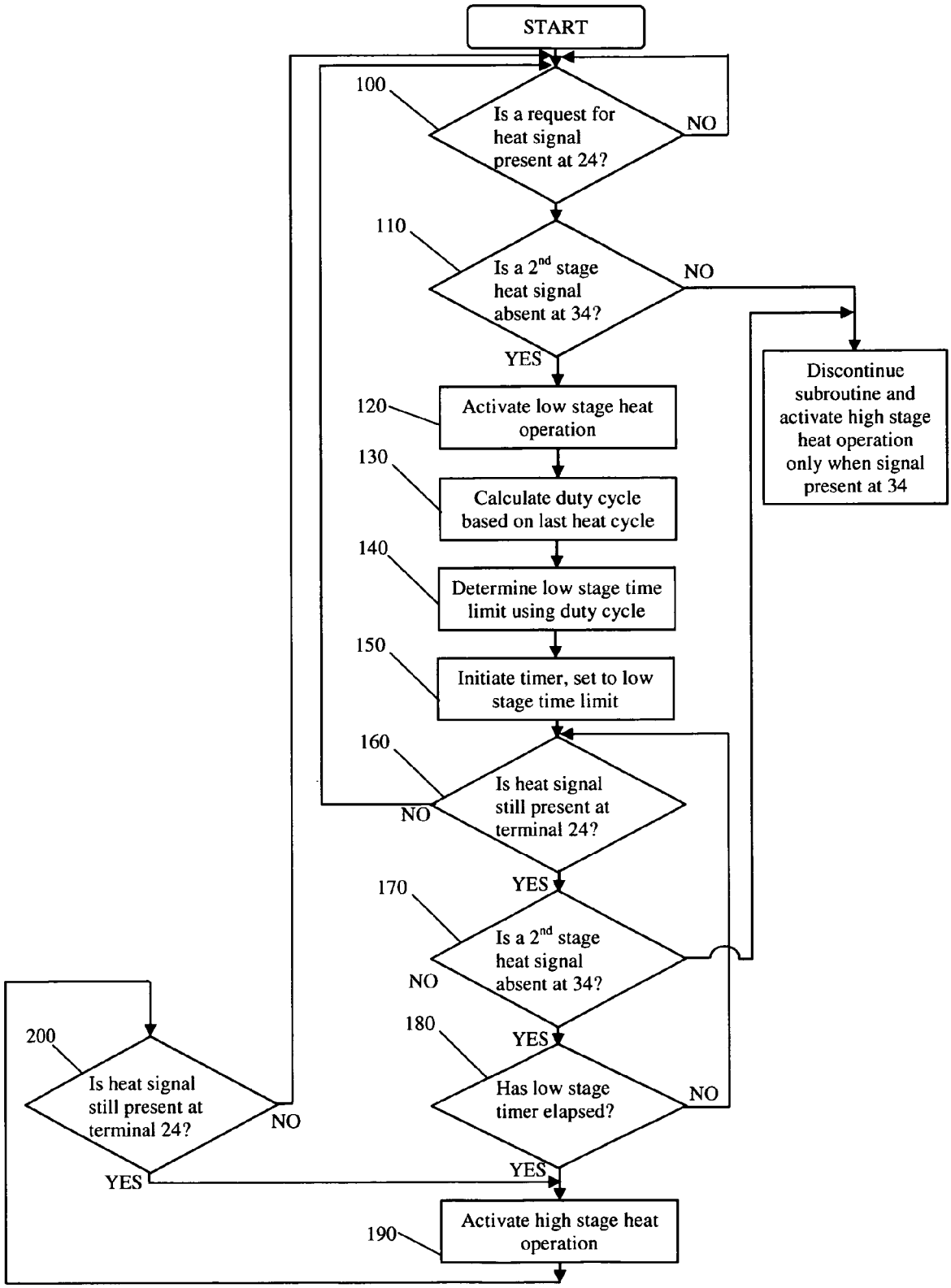
FIG. 3 is a flow chart showing a method for operating a two-stage heat source according to the principles of the present invention.

In another embodiment of a method as shown in FIG. 3, the method comprises actuating low stage heating operation at step 110 upon detecting a request signal for heat operation at a first terminal at step 100. The method includes the step of calculating a duty cycle value at 120, based on the ratio of time in which a request signal is present at the first terminal relative to the total on and off time of at least one previous heating cycle. The duty cycle step may further comprise averaging the calculated duty cycle from the last heating cycle with at least one stored duty cycle value, to yield an averaged duty cycle value that is used to determine a low stage time limit value. The method determines a low stage time limit value at step 130 from the calculated duty cycle value or averaged duty cycle value. The method also initiates a low stage timer means at step 140 after activation of the low stage heating, where the timer is set to a low stage time limit or a default value absent such a low stage time limit. Low stage heating operation is continued at step 150 as long as a signal is present at the first terminal, and at step 160 as long as the low stage time limit or the default time limit has not expired, or until detecting a request signal for high stage heating operation at a second terminal at step 170. The method then activates high stage heating operation at step 180 after the timer has expired at step 160, or upon detecting a request signal for high stage heating operation at a second terminal at step 170. High stage heating operation is continued at step 190 as long as a signal is present at the first terminal after the expiration of the timer, or as long as a signal requesting high stage heating is present at the second terminal at step 200. The method discontinues all heating operation at step 210 upon detecting that the signal at the first terminal is no longer present.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A controller for a two-stage heat source, adapted to be connected to either a single stage or two-stage thermostat, the controller comprising:

a first terminal configured for connection to the single-stage thermostat for receiving a signal requesting heat operation from the single-stage thermostat connected to the first terminal, or for connection to the two-stage thermostat for receiving a signal for first-stage heat from the two-stage thermostat connected to the first terminal;

a microcontroller in communication with the first terminal, the microcontroller being configured to calculate a duty cycle value based on a duration of time in which a heat signal is present at the first terminal relative to a duration of a heating cycle, and to determine a first stage time limit that is determined from the duty cycle, wherein the microcontroller is configured to control the operation of the two stage heat source to provide first stage low heating operation while the first stage heat signal is present up to the first stage time limit, and to provide second stage heating when the first stage heat signal is present beyond the first stage time limit period.

2. The controller of claim 1, further comprising a second terminal for receiving a signal for second stage heat from the two-stage thermostat connected to the second terminal, wherein the microcontroller is in communication with the second terminal and initiates the second stage heating upon receiving a signal for second stage heat from the two-stage thermostat.

3. The controller of claim 1, wherein the microcontroller selects a time limit value from a look-up table in a memory of the microcontroller that corresponds to said calculated duty cycle value.

4. The controller of claim 1, wherein the first stage low heat operation provides a lower level of heating than the second stage high heat operation.

5. The controller of claim 4, wherein the duty cycle value is proportionate to a heating load demand of the two stage heating system.

6. The controller of claim 5, wherein the first stage time limit value diminishes as the duty cycle value indicative of the heating load demand increases, such that the first stage heat operates for a minimum first stage time limit period prior to activation of the second stage heat operation when heating demand is high, and the first stage heat operates for a maximum first stage time limit period prior to activation of the second stage heat operation when heating demand is low.

7. The controller of claim 1, wherein the microcontroller calculates the one or more duty cycles values during said one or more heating cycles.

8. The controller of claim 1, wherein the microcontroller stores the at least one calculated duty cycle value in a memory.

9. The controller of claim 8, wherein the microcontroller averages the calculated duty cycle value and the at least one previously stored duty cycle value, and determines the first stage time limit period from the averaged duty cycle value.

10. A controller for a two-stage heat source, adapted to be connected to either a single stage or two-stage thermostat, the controller comprising:

a first terminal configured for connection to the single-stage thermostat for receiving a signal requesting heating from the single-stage thermostat connected to the first terminal, or for connection to the two-stage thermostat for receiving a signal requesting low-stage heating from the two-stage thermostat connected to the first terminal;

a second terminal for receiving a signal requesting high-stage heat operation from the two-stage thermostat connected to the second terminal;

a microcontroller in communication with the first and second terminals, the microcontroller being configured to determine a duty cycle value for one or more heating cycles based on the duration of time in which the heat signal at the first terminal is present relative to the duration of the heating cycle, and to select a low stage time limit from a number of low stage time limits corresponding to a number of duty cycle values from a look-up table in a memory of the microcontroller, wherein the microcontroller is configured to control the operation of the two stage heat source to provide low stage the low stage heating operation when the heat signal is present at the first terminal up to the low stage time limit determined from the duty cycle valve, and to provide the high stage heating operation while the heat signal is present at the first terminal beyond the low stage time limit; and wherein the microcontroller controls the operation of the two stage heat source to provide the second stage heating whenever the heat signal requesting the second stage heat operation is present at the second terminal.

11. The controller of claim 10, further comprising a timer means that is initiated upon activation of the low stage heating operation and is set to the low stage time limit, whereupon expiration of the timer the microprocessor provides for the high stage heating heating operation as long as the heat signal is still present at the first terminal.

12. The controller of claim 10, wherein the low stage time limit value diminishes as the duty cycle value indicative of a heating load demand increases, such that the low stage heat operates for a minimum low stage time limit period prior to activation of the high stage heat operation when heating demand is high, and the low stage heat operates for a maximum low stage time limit period prior to activation of the high stage heat operation when heating demand is low.

13. The controller of claim 12, further comprising a timer means that is initiated upon activation of the low stage heating operation and is set to the low stage time limit, whereupon expiration of the timer the microprocessor provides for the high stage heating operation as long as the heat signal is still present at the first terminal.

14. The controller of claim 12, wherein the microcontroller calculates the one or more duty cycles values during said one or more heating cycles.

15. The controller of claim 12, further comprising the memory in which the microcontroller stores the calculated duty cycle, wherein the microcontroller averages a subsequently calculated duty cycle value with at least one previously stored duty cycle value for determining a first stage time limit period based on the average of calculated duty cycle value with at least one previously stored duty cycle value.

16. A method for controlling the operation of a two stage furnace comprising:

determining whether a request signal for heat operation is present at a first terminal;

calculating at least one duty cycle value based on a duration of time in which the request signal was present at the first terminal in a previous heating cycle relative to the total duration of the previous heating cycle;

determining a low stage time limit value from the at least one calculated duty cycle value;

providing for low stage low-heating operation as long as a signal is present at the first terminal until the low stage time limit is reached;

providing for high stage high-heating operation after the low stage time limit has been reached, as long as the signal at the first terminal remains present; and discontinuing all heating operation when the signal at the first terminal is no longer present.

17. The method of claim 16 further comprising the step of activating the high stage high-heating operation upon detecting a request signal for the high stage high-heating operation at a second terminal.

18. The method of claim 17 wherein the low stage time limit value diminishes as the duty cycle value indicative of a heating load demand increases, such that the low stage low-heat operates for a minimum low stage time limit period prior to activation of the high stage high-heat operation when heating demand is high, and the low stage low-heat operates for a maximum low stage time limit period prior to activation of the high stage high-heat operation when heating demand is low.

19. A method for controlling the operation of a two-stage heating system, the method comprising the steps of:

actuating low stage heating operation upon detecting a request signal for heat operation at a first terminal;

calculating at least one duty cycle value based on a duration of time in which the request signal was present at the first terminal in a previous heating cycle relative to the total duration of the previous heating cycle;

determining a low stage time limit value from the at least one calculated duty cycle value;

initiating a low stage timer means that is set to the low stage time limit;

continuing the low stage low-heating operation as long as a signal is present at the first terminal until the low stage time limit expires;

activating high stage high-heating operation after the timer has expired;

continuing the high stage high-heating operation as long as a signal is present at the first terminal after the expiration of the timer; and discontinuing all heating operation when the signal at the first terminal is no longer present.

20. The method of claim 19 wherein the low stage time limit value diminishes as the duty cycle value indicative of the heating load demand increases, such that the low stage low-heat operates for a minimum low stage time limit period prior to activation of the high stage high-heat operation when heating demand is high, and the low stage low-heat operates for a maximum low stage time limit period prior to activation of the high stage high-heat operation when heating demand is low.

* * * * *